US006495300B1

(12) United States Patent
Qi et al.

(10) Patent No.: US 6,495,300 B1
(45) Date of Patent: Dec. 17, 2002

(54) PHOTOCONDUCTIVE IMAGING MEMBERS

(75) Inventors: Yu Qi, Mississauga (CA); Beng S. Ong, Mississauga (CA); Cheng-Kuo Hsiao, Mississauga (CA); Ping Liu, Mississauga (CA); Huoy-Jen Yuh, Pittsford, NY (US); John S. Chambers, Rochester, NY (US); Helen R. Cherniack, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/895,453

(22) Filed: Jul. 2, 2001

(51) Int. Cl.[7] ..... G03G 5/047; G03G 5/14

(52) U.S. Cl. ..... 430/66; 430/58.2; 430/58.6; 430/58.8; 430/97; 430/126; 399/159

(58) Field of Search ..... 430/66, 58.2, 58.6, 430/97, 126, 58.8; 399/159

(56) References Cited

U.S. PATENT DOCUMENTS

| | | | | |
|---|---|---|---|---|
| 3,121,006 A | | 2/1964 | Middleton et al. | 96/1 |
| 3,871,882 A | | 3/1975 | Wiedemann | 96/1.5 |
| 4,265,990 A | | 5/1981 | Stolka et al. | 430/59 |
| 4,555,463 A | | 11/1985 | Hor et al. | 430/59 |
| 4,587,189 A | | 5/1986 | Hor et al. | 430/59 |
| 5,473,064 A | | 12/1995 | Mayo et al. | 540/141 |
| 5,482,811 A | | 1/1996 | Keoshkerian et al. | 430/135 |
| 5,493,016 A | | 2/1996 | Burt et al. | 540/139 |
| 5,645,965 A | | 7/1997 | Duff et al. | 430/59 |
| 5,871,877 A | * | 2/1999 | Ong et al. | 430/58 |
| 5,874,193 A | * | 2/1999 | Liu et al. | 430/59 |
| 5,888,690 A | * | 3/1999 | Yoshinaga et al. | 430/66 |
| 5,910,386 A | * | 6/1999 | Yoshinaga et al. | 430/66 |
| 6,287,737 B1 | * | 9/2001 | Ong et al. | 430/58.8 |
| 6,365,309 B1 | * | 4/2002 | Tokutake et al. | 430/66 |

OTHER PUBLICATIONS

Diamond, Arthur S. (editor) Handbook of Imaging Materials. New York: Marcel–Dekker, Inc. (1991) pp. 427–434.*

Borsenberger, Paul M. Organic Photoreceptors for Imaging Systems. New York: Marcel–Dekker, Inc. pp. 181, 182, 239. (1993).*

Copending application U.S. Ser. No. 09/579,491, filed May 30, 2000, on Photoconductive Imaging Members.

* cited by examiner

*Primary Examiner*—Christopher Rodee

(74) *Attorney, Agent, or Firm*—E. O. Palazzo

(57) ABSTRACT

A photoconductive imaging member containing an optional supporting substrate, a photogenerating layer, a charge transport layer, and an overcoating layer comprised of a crosslinked composite polysiloxane-silica generated from the reaction of a silyl-functionalized hydroxyalkyl polymer of Formula (I) with an organosilane of Formula (II) in the presence of silica particles and water (I)

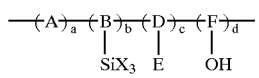

(II)

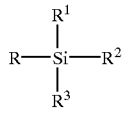

wherein A, B, D, and F represent the segments of the polymer backbone; E is a hole transporting moiety; X is selected from the group consisting of halide, cyano, alkoxy, acyloxy, and aryloxy; a, b, c, and d each represent mole fractions of the repeating monomer units such that the sum of a+b+c+d is equal to about 1; R is alkyl, substituted alkyl, aryl, or substituted aryl, and $R^1$, $R^2$, and $R^3$ are independently selected from the group consisting of alkyl, aryl, alkoxy, aryloxy, acyloxy, halide, cyano, and amino, subject to the provision that two of $R^1$, $R^2$, and $R^3$ are each independently selected from the group consisting of alkoxy, aryloxy, acyloxy, and halide.

22 Claims, No Drawings

PHOTOCONDUCTIVE IMAGING MEMBERS

COPENDING APPLICATIONS AND PATENTS

Disclosed in U.S. Pat. No. 5,645,965, the disclosure of which is totally incorporated herein by reference, are photoconductive imaging members with perylenes and a number of charge transports, such as amines.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water.

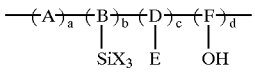

(I)

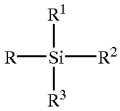

(II)

wherein A, B, D, and F represent the segments of the polymer backbone; E is an electron transporting moiety; X is selected from the group consisting of chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl, with the substituent being halide, alkoxy, aryloxy, and amino; and $R^1$, $R^2$, and $R^3$ are independently selected from the group consisting of alkyl, aryl, alkoxy, aryloxy, acyloxy, haogen, cyano, and amino, subject to the provision that two of $R^1$, $R^2$, and $R^3$ are independently selected from the group consisting of alkoxy, aryloxy, acyloxy, and halide.

Disclosed in U.S. Pat. No. 5,874,193, the disclosure of which is totally incorporated herein by reference, are photoconductive imaging members with a hole blocking layer comprised of a crosslinked polymer derived from crosslinking a alkoxysilyl-functionalized polymer bearing an electron transporting moiety. In U.S. Pat. No. 5,871,877, the disclosure of which is totally incorporated herein by reference, there are illustrated multilayered imaging members with a solvent resistant hole blocking layer comprised of a crosslinked electron transport polymer derived from crosslinking a thermally crosslinkable alkoxysilyl, acyloxysilyl or halosilyl-functionalized electron transport polymer with an alkoxysily, acyloxysilyl or halosilyl compound such as alkyltrialkoxysilane, alkyltrihalosilane, alkylacyloxysilane, aminoalkyltrialkoxysilane, and the like, in contact with a supporting substrate and situated between the supporting substrate and a photogenerating layer, and which layer may be comprised of the photogenerating pigments of U.S. Pat. No. 5,482,811, the disclosure of which is totally incorporated herein by reference, especially Type V hydroxygallium phthalocyanine. Advantages of the imaging members of the present invention with respect to U.S. Pat. No. 5,871,877 include, for example, a more rapid crosslinking rate, for example, in embodiments less than about one minute, and water can be added to accelerate the crosslinking reaction. Short crosslinking or curing times of, for example, 1 minute is very useful for the web coating of a photoreceptor belt since the coating operation is continuous and does not usually tolerate undue delay in the fabrication of the blocking layer. The imaging members of the present invention in embodiments also exhibit excellent electrical properties such as low residual potential voltage and stable cyclic characteristics in various environmental conditions.

Illustrated in U.S. Pat. No. 5,493,016, the disclosure of which is totally incorporated herein by reference, are imaging members comprised of a supporting substrate, a photogenerating layer of hydroxygallium phthalocyanine, a charge transport layer, a perylene photogenerating layer, which is preferably a mixture of bisbenzimidazo(2,1-a-1', 2'-b)anthra(2,1,9-def:6,5,10-d'e'f')diisoquinoline-6,11-dione and bisbenzimidazo(2,1-a:2', 1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by the reaction of gallium chloride in a solvent, such as N-methylpyrrolidone, present in an amount of from about 10 parts to about 100 parts, and preferably about 19 parts with 1,3-diiminoisoindolene in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Further, illustrated in U.S. Pat. No. 5,645,965, the disclosure of which is totally incorporated herein by reference, are symmetrical perylene photoconductive members.

The appropriate components and processes of the above copending applications and the above patents may be selected for the present invention in embodiments thereof.

BACKGROUND OF THE INVENTION

This invention is generally directed to imaging members, and more specifically, the present invention is directed to multilayered photoconductive imaging members with a protective overcoating layer comprised of a crosslinked polysiloxane derived, for example, from crosslinking a trialkoxysilyl-functionalized hydroxyalkyl acrylate or trialkoxysilyl-functionalized hydroxyalkyl alkacrylate with an aminoalkylalkoxysilane, such as gamma-aminoalkyltrialkyloxysilane, and with silica particles dispersed therein. The presence of a hydroxyalkyl moiety in the trialkoxysilyl-functionalized polymer enables, for example, the addition of water to the coating solution without substantially causing phase separation. Water is usually utilized for curing or crosslinking of the overcoated layer. The incorporation of silica particles in the overcoating composition primarily, for example, facilitates rapid crosslinking of the coated layer, and can enhance the mechanical durability of this layer. The imaging members of the present invention in embodiments exhibit excellent cyclic/environmental stability, and substantially no adverse changes in their performance over extended time periods, excellent resistance to mechanical abrasion, and therefore extended photoreceptor life. The aforementioned photoresponsive, or photoconductive imaging members can be negatively charged when the photogenerating layer is situated between the charge transport layer and the substrate.

Processes of imaging, especially xerographic imaging and printing, including digital, are also encompassed by the present invention. More specifically, the layered photoconductive imaging members of the present invention can be selected for a number of different known imaging and printing processes including, for example, color processes, digital imaging process, digital printers, PC printers, and electrophotographic imaging processes, especially xerographic imaging and printing processes wherein charged latent images are rendered visible with toner compositions of an appropriate charge polarity. The imaging members of the present invention are in embodiments sensitive in the wavelength region of, for example, from about 500 to about 900 nanometers, and more specifically, from about 650 to about 850 nanometers, thus diode lasers can be selected as the light source. Moreover, the imaging members of this invention are useful for color xerographic systems.

PRIOR ART

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

The use of perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl4,4'-diamine dispersed in a polycarbonate binder, as a hole transport layer. The above components, such as the photogenerating compounds and the aryl amine charge transport can be selected for the imaging members of the present invention.

SUMMARY OF THE INVENTION

It is a feature of the present invention to provide imaging members with many of the advantages illustrated herein, such as for example extended, serviceable life and satisfactory imaging performance.

Another feature of the present invention relates to the provision of a protective overcoating layer on the imaging member, and wherein the application of the overcoating and its subsequent curing and drying are compatible with a number of existing imaging fabrication processes such as, for example, rapid curing of the overcoating layer in about 1 minute or less.

A further feature of the present invention is the provision of improved layered photoresponsive imaging members which are responsive to near infrared radiation exposure.

It is yet another feature of the present invention to provide improved layered photoresponsive imaging members overcoated with a tough overcoat with excellent mechanical wear resistance characteristics.

In a further feature of the present invention there are provided imaging members containing crosslinked overcoating layers which possess excellent adhesion to the transport layer.

Aspects of the present invention relate to a photoconductive imaging member comprised of an optional supporting substrate, a photogenerating layer, a charge transport layer, and an overcoating layer comprised of a crosslinked composite polysiloxane-silica generated from the reaction of a silyl-functionalized hydroxyalkyl polymer of Formula (I) with an organosilane of Formula (II) in the presence of silica particles and water

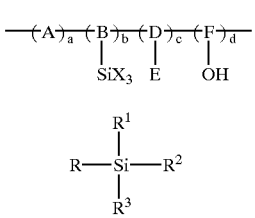

(I)

(II)

wherein A, B, D, and F represent the segments of the polymer backbone; E is a charge such as a hole transporting moiety; X is, for example, selected from the group consisting of halide, cyano, alkoxy, acyloxy, and aryloxy; a, b, c, and d each represent mole fractions of the repeating monomer units such that the sum of a+b+c+d is equal to about 1; R is, for example, alkyl, substituted alkyl, aryl, or substituted aryl, and $R^1$, $R^2$, and $R^3$ are independently selected, for example, from the group consisting of alkyl, aryl, alkoxy, aryloxy, acyloxy, halide, cyano, and amino, subject to the provision that, for example, two of $R^1$, $R^2$, and $R^3$ are each independently, for example, selected from the group consisting of alkoxy, aryloxy, acyloxy, and halide; a photoconductive imaging member comprised in sequence of a supporting substrate, a photogenerating layer, a charge transport layer, and an overcoating, and wherein the overcoating layer is comprised of a crosslinked polysiloxane-silica composite composition derived from the reaction of nanosized silica particles, a silyl-functionalized hydroxyalkyl polymer of Formula (I) and an organosilane of Formula (II)

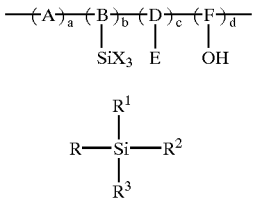

(I)

(II)

wherein A, B, D, and F represent the segments of the polymer backbone; E is a charge transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, haogen, cyano, and amino, subject to the provision that two of $R^1$, $R^2$, and $R^3$ are independently selected from the group consisting of alkoxy, aryloxy, acyloxy, and halide, and wherein said reaction is accomplished in the presence of a silica; a photoconductive imaging member comprised of a supporting substrate, an optional hole blocking layer thereover, a photogenerating layer, a charge transport layer, and a top overcoating protective layer comprised of a crosslinked polymer composition derived from the reaction of polymer (I) and an organosilane represented by Formula (II) in the presence of nanosized, for example equal to or less than about 1 micron in diameter, silica particles, which particles can function as a filler. The overcoating polymer of the present invention can be schematically represented by (III), which is derived from, for example, the crosslinking reaction as illustrated in Scheme 1

Scheme 1

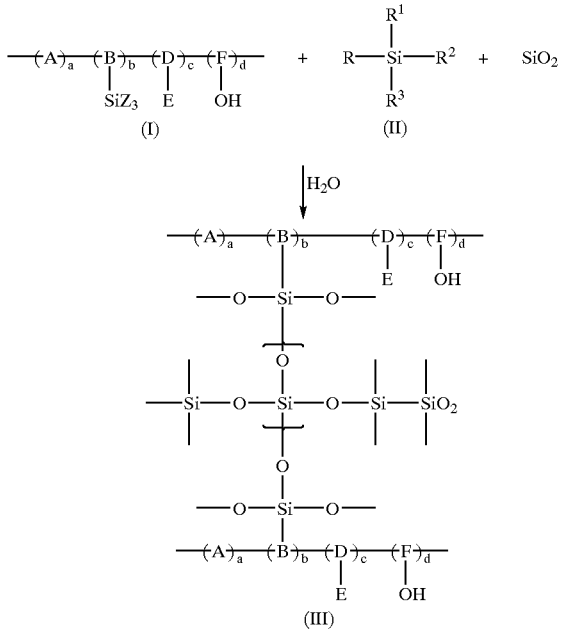

(I) (II) (III)

wherein E is a hole transport moiety; A, B, D, and F represents the segments of the polymer backbone containing appropriate divalent linkages, which connect or bond the silyl function ($SiZ_3$) or $SiX_3$, to the hole transport moiety (E), and the hydroxy function (OH) to the polymer backbone; Z is selected from the group consisting of halide, such as chloride, bromide, or iodide; cyano, alkoxy of, for example, from about 1 to about 5 carbon atoms, acyloxy of, for example, from about 2 to about 6 carbon atoms, aryloxy of, for example, from about 6 to about 10 carbon atoms; a, b, c, and d are mole fractions of the repeating monomer units wherein a+b+c+d is equal to 1; R is alkyl, substituted alkyl, aryl, or substituted aryl, with the substituent being halogen, alkoxy, aryloxy, amino, and the like; and $R^1$, $R^2$, and $R^3$ are independently selected from the group consisting of alkyl, aryl, alkoxy, aryloxy, acyloxy, halide, cyano, and amino provided that two of $R^1$, $R^2$, and $R^3$ are independently selected from the group consisting of alkoxy, aryloxy, acyloxy, and halogen; a photoconductive imaging member wherein a is from about 0 to about 0.95, b is from about 0.001 to about 0.50, c is from about 0 about 0.50, and d is from about 0.01 to about 0.95; a photoconductive imaging member wherein A is selected from the group of divalent linkages, such as alkylene, arylene, alkoxycarbonylalkylene, alkoxycarbonylarylene, and the like, while B, D and F are independently selected from the group consisting of, for example,

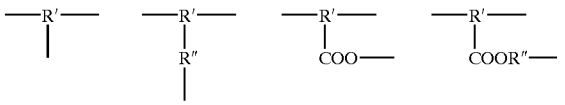

wherein R' and R" are independently trivalent linkages and divalent linkage of, for example, from about 2 to about 24 carbon atoms.

The overcoating layer of the imaging members of the present invention can also be generated from the crosslinking of the silyl-functionalized polymer of Formula (IV) and an organosilane (II) in the presence of nanosized silica particles with or without a suitable catalyst (IV)

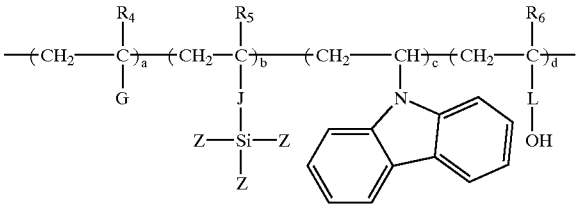

wherein $R^4$, $R^5$, and $R^6$ are hydrogen or alkyl, Z is selected from the group consisting of chloride, bromide, iodide, cyano, alkoxy of about 1 to about 10 carbon atoms, and acyloxy of about 2 to about 10 carbon atoms; J is a divalent linkage selected, for example, from the group consisting of alkyleneoxycarbonyl of about 2 to about 10 carbon atoms, arylene of about 6 to about 24 carbon atoms, alkylenearyl of about 7 to about 34 carbon atoms, aryleneoxycarbonyl of about 7 to about 25 carbon atoms, and alkylenearyloxycarbonyl of about 8 to about 25 carbon atoms; L is selected, for example, from the group consisting of arylene of about 6 to about 24 carbon atoms, alkylenearyl of about 7 to about 25 carbon atoms, alkyleneoxycarbonyl of about 2 to about 10 carbon atoms, and the like; G is, for example, selected from the group consisting of halide, such as bromide, chloride, or cyano, aryl of about 6 to about 15 carbon atoms, alkoxycarbonyl of 2 to about 15 carbon atoms, fluoroalkoxycarbonyl of 2 to about 15 carbon atoms, aryloxycarbonyl of 7 to about 15 carbon atoms, and the like; a, b, c, and d represent the mole fractions of the repeating units of the polymer, and wherein, for example, a is from about 0 to about 0.95, b ranges from about 0.001 to about 0.50, c ranges from about 0 to about 0.50, d ranges from about 0.01 to 0.95, and wherein the sum of a+b+c+d is equal to 1, or other combinations of values for a, b, c, and d; the $M_n$ of (IV) can be, for example, from about 1,000 to about 50,000, and the $M_w$ can be from about 10,000 to about 100,000; a photoconductive imaging member wherein G is alkoxycarbonyl of from, for example is intended throughout when ranges or numbers are recited, about 2 to about 10 carbon atoms, Z is alkoxy of from about 1 to about 5 carbon atoms; a photoconductive imaging member wherein G is methoxycarbonyl, Z is an alkoxy such as methoxy or ethoxy, and L is arylene of about 6 to about 15 carbon atoms, arylenealkyl of about 7 to about 15 carbon atoms, alkyleneoxycarbonyl of about 2 to about 10 carbon atoms, and the like; a photoconductive imaging member wherein the overcoating layer polymer is derived from polymer (IV) selected, for example, from the group consisting of polymers of the formulas (IV-a) through (IV-h) illustrated herein; a photoconductive imaging member wherein the organosilane (II) is selected from the group consisting of alkylhalosilanes, alkylalkoxysilanes, aminoalkylsilanes, and the like, such as methyltrichlorosilane, dimethyldichlorosilane, methyltrimethoxysilane, methyltriethoxysilane, ethyltrichlorosilane, ethyltrimethoxysilane, dimethyldimethoxysilane, methyltriethoxysilane, ethyltriethoxysilane, propyltrimethoxysilane, 3-aminopropyltrimethoxysilane, 3-aminopropyl triethoxysilane, and the like; a photoconductive imaging member wherein organosilane (II) is 3-aminopropyltrimethoxysilane or 3-aminopropyl triethoxysilane; a photoconductive imaging member comprised in the following sequence of a supporting substrate, an adhesive layer, a photogenerating layer, a charge transport layer and an overcoating crosslinked polymer layer of the formulas illustrated herein and which layer can be generated in the presence of silica particles, a photoconductive imaging member wherein the adhesive layer is comprised of a polyester with an $M_w$ of from about 20,000 to about 100,000, and more specifically, about 35,000, and an $M_n$ of from about 10,000 to about 50,000 or about 14,000; a photoconductive imaging member wherein the supporting substrate is comprised of a conductive metal substrate; a photoconductive imaging member wherein the conductive substrate is aluminum, aluminized or titanized polyethylene terephthalate belt (MYLAR®); a photoconductive imaging member wherein said photogenerator layer is of a thickness of from about 0.05 to about 10 microns; a photoconductive imaging member wherein the transport layer is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging member wherein the aryl amines are of the formula

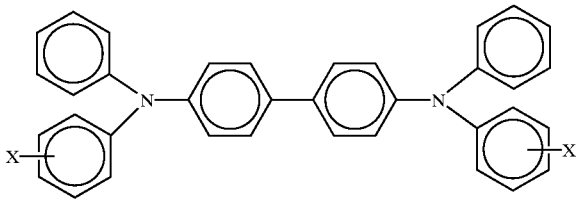

wherein X selected from the group consisting of alkyl and halogen, and wherein the aryl amine is dispersed in a highly insulating and transparent resinous binder; a photoconductive imaging member wherein the arylamine alkyl contains from about 1 to about 10 carbon atoms; a photoconductive imaging member wherein the arylamine alkyl contains from 1 to about 5 carbon atoms; a photoconductive imaging member wherein the arylamine alkyl is methyl, wherein halogen is chlorine, and wherein the resinous binder is selected from the group consisting of polycarbonates and polystyrenes; a photoconductive imaging member wherein the aryl amine is N,N'-diphenyl-N,N-bis(3-methylphenyl)-1,1'-biphenyl-4,4'-diamine; a photoconductive imaging member further including an adhesive layer of a polyester with an $M_w$ of preferably about 70,000, and an $M_n$ of from about 25,000 to about 50,000, and preferably about 35,000; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; a method of imaging which comprises generating an electrostatic latent image on the imaging member, developing the latent image, and transferring the developed electrostatic image to a suitable substrate; a photoconductive imaging member wherein the overcoating layer is derived from the crosslinking of polymer (IV) and an organosilane (II) in the presence of silica particles and a catalyst selected from the group consisting of carboxylic acids and amines; a photoconductive imaging member wherein acetic acid or an alkylamine is selected as the catalyst; an imaging member wherein a crosslinked composite siloxane layer is selected as the overcoat layer, and which layer is generated from the reaction of polymer (IV) and organosilane (II) in the presence of silica particles: imaging members comprised of a supporting substrate thereover a photogenerating layer of, for example, hydroxygallium phthalocyanine, a charge transport layer and thereover a overcoating of a thickness of from about 0.5 micron to about 10 microns, and which coating is comprised of a composite crosslinked polysiloxane-silica layer.

In embodiments thereof, the overcoating layer is comprised of a crosslinked polysiloxane-silica composite layer as schematically represented by Formula (V) derived from the reaction of polymer (IV) and an organosilane (II) in the presence of silica particles, according to Scheme 2.

Specific illustrative examples of the polymer backbone segments, such as A, are

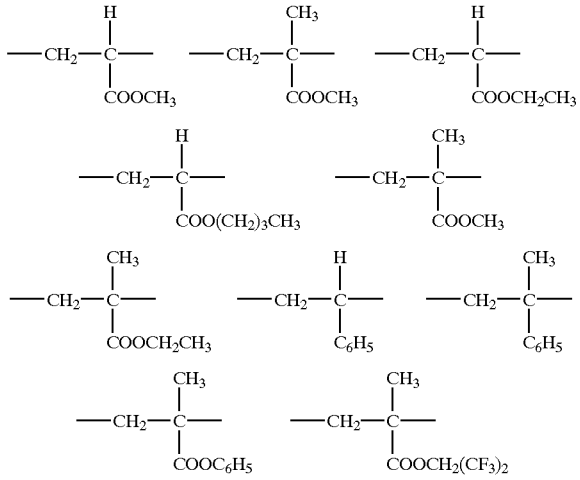

Scheme 2

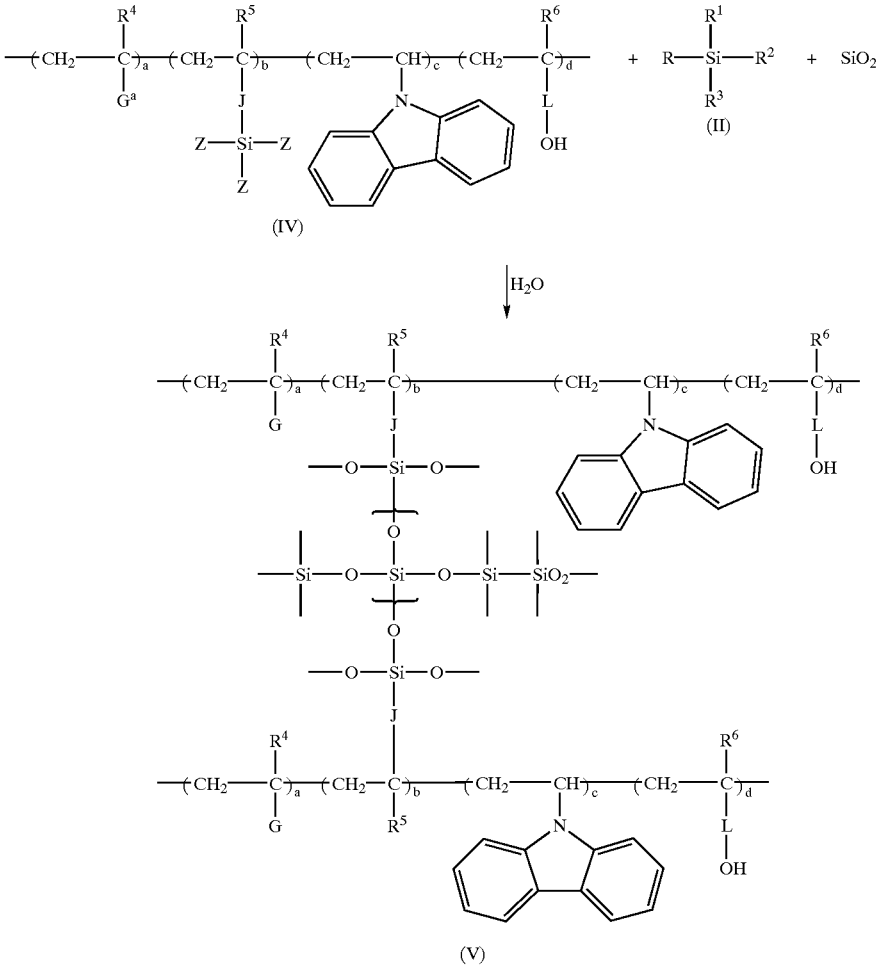

-continued

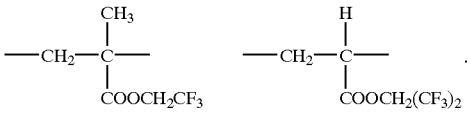

Specific illustrative examples of B, D and F are

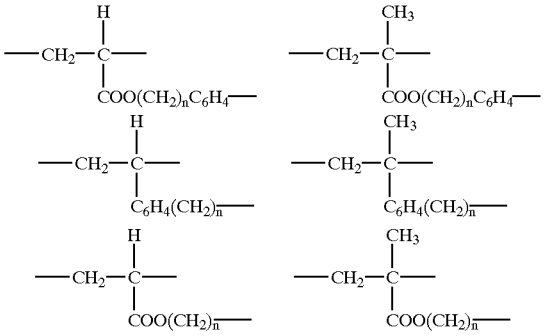

wherein n is, for example, from 1 to 6.

Illustrative examples of J are alkyleneoxycarbonyl (—R'—O—CO—) of about 2 to about 10 carbon atoms, arylene (—Ar—) of about 6 to about 15 carbon atoms, alkylenearyl (—R'—Ar—) of about 7 to about 15 carbon atoms, aryleneoxycarbonyl (—Ar—O—CO—) of about 7 to about 15 carbon atoms, and alkylenearyloxycarbonyl (—R'—Ar—O—CO—) of about 8 to about 25 carbon atoms; alkyleneoxycarbonyl (—R'—O—CO—) of about 2 to about 10 carbon atoms; and illustrative examples of L are arylene (—Ar—) of about 6 to about 15 carbon atoms, alkylenearyl (—R'—Ar—) of about 7 to about 15 carbon atoms, and alkyleneoxycarbonyl (—R'—O—CO—) of about 2 to about 10 carbon atoms; and wherein R is alkyl, substituted alkyl, aryl, or substituted aryl, with the substituent being halogen, alkoxy, aryloxy, amino, and the like; and $R^1$, $R^2$, and $R^3$ are independently selected from the group consisting of alkyl, aryl, alkoxy, aryloxy, acyloxy, halide, cyano, and amino provided that two of $R^1$, $R^2$, and $R^3$ are independently selected from the group consisting of alkoxy, aryloxy, acyloxy, and.halide.

Illustrative examples of the organosilane (II) that can be selected for the preparation of the overcoat layers of the present invention are alkyl silanes, alkoxysilanes, and aminosilanes such as methyltrichlorosilane, dimethyldichlorosilane, methyltrimethoxysilane, methyltriethoxysilane, ethyltrichlorosilane, ethyltrimethoxysilane, dimethyidimethoxysilane, methyltriethoxysilane, ethyltriethoxysilane, propyltrimethoxysilane, 3-aminopropyltrimethoxysilane, 3-aminopropyl triethoxysilane, and the like.

In embodiments of the present invention, polymers (IV) that are utilized in the preparation of the overcoating layer are selected from the group consisting of polymers (IV-a) through (IV-h):

(IV-a)

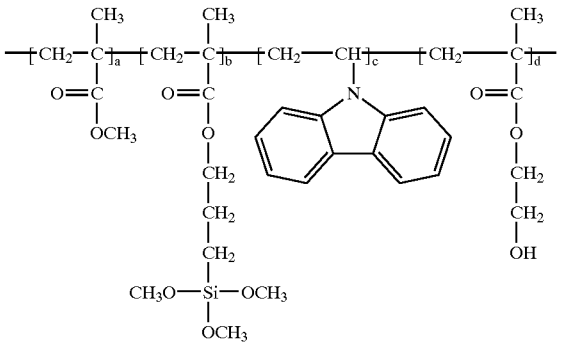

(IV-b)

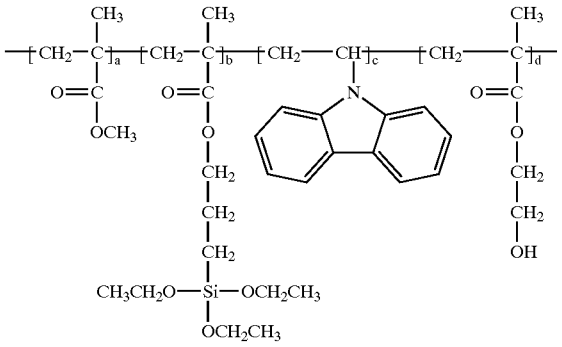

(IV-c)

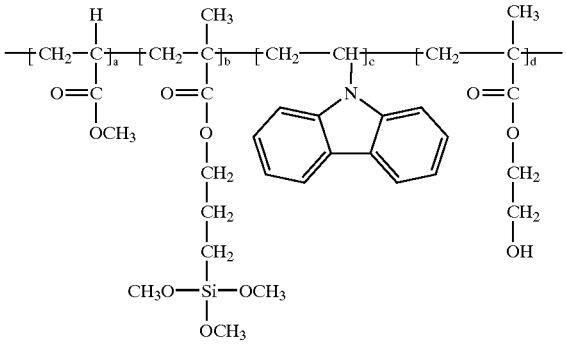

(IV-d)

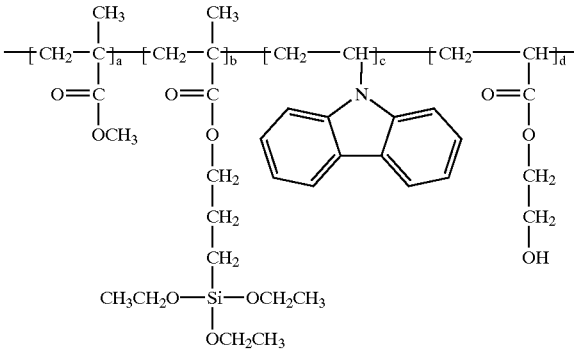

-continued (IV-e)

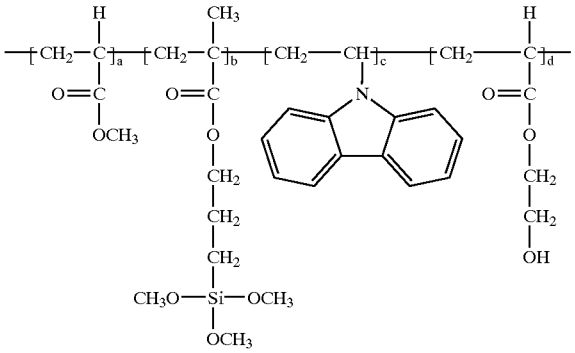

(IV-f)

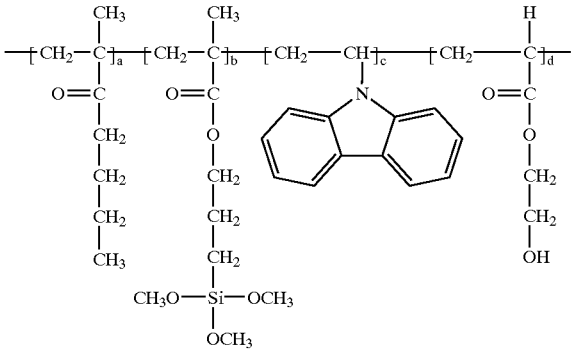

(IV-g)

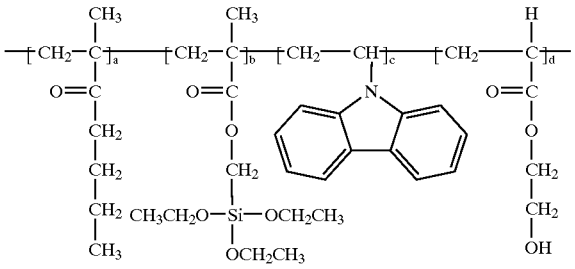

-continued (IV-h)

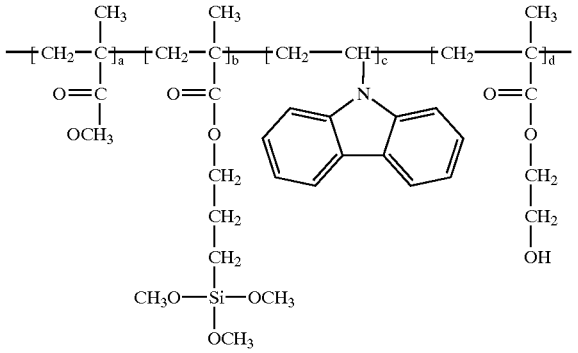

Polymer (IV) can be prepared, for example, by free radical polymerization according to Scheme 3. Specifically, this polymer can be prepared by the polymerization of a mixture of vinyl monomers (VI), (VII), (VIII) and (IX) in the presence of a suitable radical initiator such as benzoyl peroxide, 2,2'-azobis(2-methylpropanenitrile), and the like. The polymerization is generally accomplished in an inert solvent, such as toluene, benzene, tetrahydrofuran, chloroform, or the like, at a temperature of, for example, between about 30° C. to about 120° C. A specific preparative procedure for polymer (IV) is as follows. A mixture of monomers (VI), (VII), (VIII) and (IX) in effective molar equivalent amounts, and a solvent, such as toluene or tetrahydrofuran, is first charged to a reactor. The mixture is stirred at a temperature ranging from ambient to about 70° C. for about 5 to about 30 minutes. Subsequently, an initiator such as 2,2'-azobis(2-methyl propanenitrile) is added and the mixture is heated at about 50° C. to about 100° C. for a suitable period of time, for example from 1 to 24 hours to complete the polymerization. After the polymerization, the reaction mixture is diluted with a solvent, such as toluene or tetrahydrofuran, and poured into hexane with vigorous stirring to precipitate the polymer product. The polymer is collected by filtration: and dried in vacuo to provide polymer (IV), which is characterized by gel permeation chromatography (GPC), and other relevant spectroscopic techniques such as IR and NMR spectroscopy.

Scheme 3

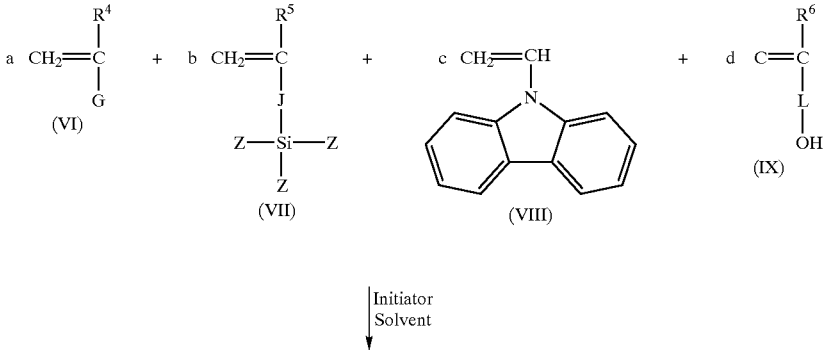

-continued

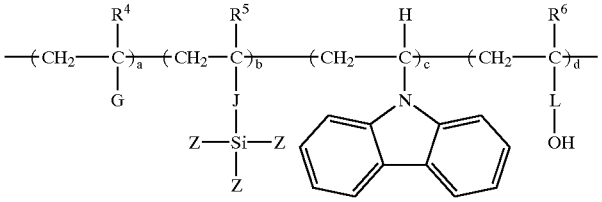

(IV)

Illustrative examples of monomer (VI) selected for the preparation of polymer (IV) include acrylic and methacrylic esters such as methyl acrylate, ethyl acrylate, propyl acrylate, butyl acrylate, methyl methacrylate, ethyl methacrylate, propyl methacrylate, butyl methacrylate, phenyl acrylate, phenyl methacrylate, and the like. Illustrative examples of monomer (VII) include 3-acryloxypropyltrimethoxysilane, 3-methacyloxy propyltrimethoxysilane, 3-acryloxypropyltriethoxysilane, 3-methacyloxypropyl triethoxysilane, 3-acryloxyethyltrimethoxysilane, 3-methacyloxyethyl trimethoxysilane, 3-methacryloxypropyl-dimethylethoxysilane, allyltrimethoxysilane, allyltriethoxysilane, and the like, and examples of vinyl monomer (VIII) include 9-vinylcarbazole and the like. Illustrative examples of monomer (IX) include 2-hydroxyethyl methacrylate, hydroxypropyl methacrylate, 2-hydroxyethyl arylate, hydroxypropyl acylate, 4-hydroxybutyl acrylate, 2-allyphenol, allyl alcohol, 2-allyl-6-methoxyphenol, 4-allyl-2-methoxyphenol, 4-ally-2,6-dimethoxyphenol, and the like; a, b, c and d represent mole equivalents of (VI) (VII), (VIII) and (IX), respectively, or mole fractions of the repeating units of polymer (IV) such that a ranges from about 0 to about 0.5, b ranges from about 0.001 to about 0.5, c ranges from about 0 to about 0.50, and d ranges from about 0.10 to about 0.95 provided that a+b+c+d is equal to 1.

With embodiments of the present invention, the fabrication of the overcoating layers of the present invention involves coating a dispersion of nano-sized silica particles in a solution of polymer (IV), organosilane (II) and water in a suitable solvent onto the charge transport layer. The dispersion can be prepared by mixing the silica particles, polymer (IV), organosilane (II) and water in a solvent by ball milling. Typical coating techniques include spraying, dip coating, roll coating, wire wound rod coating, and the like. The coated layer is then thermally dried and cured at elevated temperatures. The curing or crosslinking can generally be accomplished at, for example, about 40° C. to about 200° C., and more specifically, from about 80° C. to about 150° C. for a suitable time period such as from about 0.1 minute to about 2 hours. The crosslinking processes, as schematically depicted in Scheme 4, involve the hydrolysis of the silyl groups of organosilane (II) and polymer (IV) to the hydroxysilyl functions, which undergo condensation with the hydroxysilyl functions at the silica particle surface to form siloxane (Si—O—Si) bonds. The incorporation of silica particles into the overcoating layer can provide improved imaging member mechanical property, and the presence of silica particles also can enhance the crosslinking reaction during the fabrication of the overcoating layer. From, for example, about 0.001 to about 10 weight percent of water is present in the coating solution to effect the hydrolysis and allow crosslinking reaction to occur. Trace amounts of water, such as for example about 0.01 percent by weight of solvent that are present in the coating solvents, may often be sufficient to induce the required hydrolysis reaction. Also, water may be added, particularly if the coating solvent is a water-mixable one such as methanol, ethanol, methyl ethyl ketone. Additionally, curing or crosslinking of the overcoat layer may also be induced to occur by humidification via exposing to a moist.atmosphere prior to or during thermal treatment.

Scheme 4

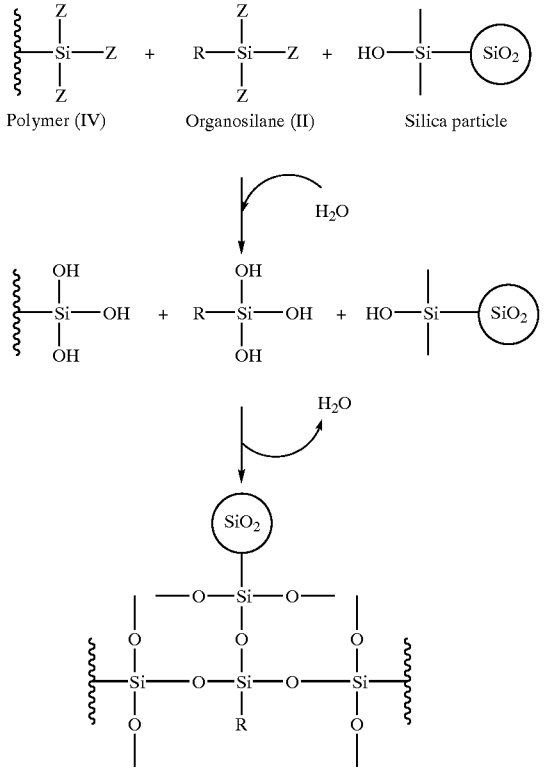

The silica particles, such as $SiO_2$, and silica particles present in toner compositions can be selected for the overcoatings of the imaging members of the present invention are readily available commercially. For example, the AEROSIL® silicas from Degussa, such as hydrophilic AEROSIL® OX50, 130, 150, 200, 300, 380, can be selected and utilized in an effective amount in the overcoating layers of, for example, from about 1 to about 25, and more specifically, from about 2 to about 10 weight percent. The particle size of silica particles is, for example, from about 7 to about 100 nanometers, and more specifically, from about 7 nanometers to about 50 nanometers.

The substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of a minimum thickness providing there are no adverse effects on the member. In one embodiment, the thickness of this layer is from about 75 microns to about 300 microns.

The photogenerating layer can contain known photogenerating pigments, such as metal phthalocyanines, metal free phthalocyanines, hydroxygallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components, such as selenium, especially trigonal selenium. The photogenerating pigment can be dispersed in a resin binder, similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of the layer in an embodiment is dependent primarily upon factors, such as photosensitivity, electrical properties and mechanical considerations. The photogenerating layer binder resin, present in various suitable amounts, for example from about 1 to about 50, and more specifically, from about 1 to about 10 weight percent, may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select a coating solvent that does not substantially disturb or adversely effect the other previously coated layers of the device. Examples of solvents that can be selected for use as coating solvents for the photogenerator layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesives usually in contact with the supporting substrate layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention desirable electrical and optical properties.

Aryl amines selected for the charge transporting layers, which generally is of a thickness of from about 5 microns to about 75 microns, and preferably of a thickness of from about 10 microns to about 40 microns, include molecules of the following formula

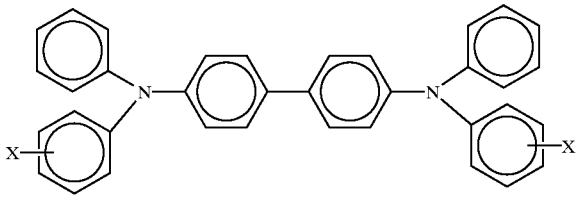

dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N, N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the highly insulating and transparent polymer binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Synthesis of Polymer (IV-a) with a=0.28, b=0.02, c=0.10, and d=0.60:

To a 500-milliliter three-neck round-bottomed flask under a nitrogen blanket, were added 2.803 grams of methyl methacrylate, 7.808 grams of 2-hydroxyethyl methacrylate, 1.932 grams of 9-vinylcarbazole, 0.4967 gram of 3-(trimethoxysilyl) propyl methacrylate, and 76.92 milliliters of tetrahydrofuran. The resulting mixture was stirred at about 50° C. for 10 minutes, followed by the addition of 0.1263 gram of 2,2'-azobis(isobutyronitrile) initiator. The mixture was subsequently refluxed for 24 hours. The resulting polymer solution was diluted with 300 milliliters of tetrahydrofuran at room temperature, about 25° C. throughout, and was then poured into 3,000 milliliters of hexane with stirring to precipitate the polymer product. The precipitated polymer product was collected by filtration and dried at room temperature in vacuo for 24 hours to provide 11.9 grams (97 percent) of polymer (IV-a). The polymer displayed an $M_w$ of 43,426 and an $M_n$ of 17,822 as measured by GPC and IR (film) absorption of 1,736 (C=O) $cm^{-1}$, and 3,467(OH).

EXAMPLE II

Synthesis of Polymer (IV-a) with a=0.68, b=0.02, c=0, and d=0.40:

The polymer was prepared in accordance to the procedure of Example I except that 20.42 grams of methyl methacrylate, 1.49 grams of 3-(trimethoxysilyl) propyl methacrylate, 11.71 grams of 2-hydroxyethyl methacrylate, 240 milliliters of tetrahydrofuran, and 0.394 gram of 2,2'-azobis(isobutyronitrile) initiator were utilized. The yield was 30 grams (89.2 percent).

The polymer displayed an $M_w$ of 29,762 and an $M_n$ of 12,537 as measured by GPC and IR (film) absorption of 1,736 (C=O) $cm^{-1}$ and 3,467 $cm^{-1}$ (OH).

EXAMPLE III

Synthesis of Polymer (IV-a) with a=0.48, b=0.02, c=0, and d=0.50:

The polymer was prepared in accordance to the procedure of Example I except that 24.03 grams of methyl methacrylate, 2.48 grams of 3-(trimethoxysilyl) propyl methacrylate, 32.54 grams of 2-hydroxyethyl methacrylate, 385 milliliters of tetrahydrofuran, and 0.63 gram of 2,2'-azobis(isobutyronitrile) initiator were utilized. The yield was 55 grams (93.1 percent).

The polymer displayed an $M_w$ of 33,358 and an $M_n$ of 13,138 as measured by GPC and IR (film) absorption of 1,735 (C=O) $cm^{-1}$ and 3,468 $cm^{-1}$ (OH).

EXAMPLE IV

An illustrative photoresponsive imaging device incorporating the overcoating layer (OCL) was fabricated as follows.

On a 75 micron thick titanized MYLAR® substrate was coated by draw bar technique a barrier layer formed from hydrolyzed gamma aminopropyltriethoxysilane having a thickness of 0.005 micron. The barrier layer coating composition was prepared by mixing 3-aminopropyltriethoxysilane with ethanol in a 1:50 volume ratio. The coating was allowed to dry for 5 minutes at room temperature, followed by curing for 10 minutes at 110° C. in a forced air oven. On top of the blocking layer was coated a 0.05 micron thick adhesive layer prepared from a solution of 2 weight percent of a DuPont 49K (49,000) polyester in dichloromethane. A 0.2 micron photogenerating layer was then coated on top of the adhesive layer from a dispersion of hydroxy gallium phthalocyanine Type V (0.46 gram) and a polystyrene-b-polyvinylpyridine block copolymer binder (0.48 gram) in 20 grams of toluene, followed by drying at 100° C. for 10 minutes. Subsequently, a 25 micron hold transport layer (CTL) was coated on top of the photogenerating layer from a solution of N,N'-diphenyl-N,N-bis(3-methyl phenyl)-1,1'-biphenyl4,4'-diamine (2.64 grams) and a polycarbonate (3.5 grams) in 40 grams of dichloromethane. The above layered device was then overcoated with a dispersion obtained from ball milling for 3 days a mixture of 0.56 gram of polymer (IV-a) of Example II, 0.24 gram of 3-aminopropyltrimethoxysilane and 0.016 gram of AEROSIL® 200 silica particles in 7.34 grams of a 98.53/1.48 (by weight percent) mixture of ethanol/water. After coating, the resulting device was dried and cured at 135° C. for 15 minutes to provide an overcoat layer encompassed schematically by Formula (v) with a thickness of about 3 microns. The cured overcoat layer exhibited excellent resistance, that is no adverse effects or dissolving, to common organic solvents such as, for example, methylenechloride, methanol, ethanol and the like.

A control device was also prepared in a similar manner without an overcoating layer.

The xerographic electrical properties of the imaging members can be determined by known means, including as indicated herein electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members attained a surface potential of $V_{ddp}$, dark development potential. Each member was then exposed to light from a filtered Xenon lamp with a XBO 150 watt bulb, thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter.

An illustrative wear test on the drum photoreceptor device of the present invention was accomplished as follows.

Photoreceptor wear was determined by the difference in the thickness of photoreceptor before and after the wear test. For the thickness measurement, the photoreceptor was mounted onto the sample holder to zero the permascope at the uncoated edge of the photoreceptor. Then its thickness was measured at every one-inch interval from the top edge of the coating along its length using a permascope, ECT-100, to obtain an average thickness value. For the wear test, the photoreceptor drum was mounted in the xerographic customer replacement unit (CRU) and set into the wear test fixture for 100,000-cycle wear test. The wear test fixture contained of a CRU, power supply for the BCR (biased charge roll), development roll (DR), a LED for light exposure, and a control unit to control the charging times of BCR, DR and LED and the rotation of the photoreceptor test device. The CRU contained a photoreceptor, cleaning blade, a BCR, a DR, and a toner cartridge. The timing was set such that the photoreceptor was rotated for 10 cycles in 8 seconds and off (stop the rotation) for 1 second. During the 10 cycle rotation, the BCR was powered with a 2100 volt peak to peak AC voltage with a −450 volt DC bias. The DR was on for 300 milliseconds after the BCR charging was switched on. The LED was turned on for 500 milliseconds, 2 seconds after the DR was turned on. Therefore, for each 10 cycle run, the photoreceptor was charged to −450 V surface voltage for close to 8 seconds and developed with black toners, and then cleaned with a blade. The 10 cycle experiment was repeated for 10,000 times such that the photoreceptor was subject to a total of 100,000 cycles in the wear fixture.

The following table summarizes the electrical performance of these devices wherein OCL represents overcoating layers.

| Device No. | CTL (μm) | $V_{ddp}$ (V) | E1/2 (Ergs/cm$^2$) | Dark Decay (V/500 ms) | Vr (V) | Wear (nm/kcycles) |
|---|---|---|---|---|---|---|
| Control Device Without OCL | 24.9 | 804 | 1.43 | 8.9 | 15.2 | 60–100 |
| Device with 4.1 μm Crosslinked Siloxane OCL | 29.3 | 814 | 1.61 | 10.2 | 15.4 | 40–80 |

EXAMPLE V

A photoresponsive imaging device with an overcoating layer of the present invention was fabricated in accordance with the procedure of Example IV except that the amount of silica was increased to 0.04 gram instead of the 0.016 gram of Example IV. The overcoating layer was prepared from a dispersion of 0.56 grams of polymer (IV-a) of Example II, 0.24 gram of 3-aminopropyltrimethoxysilane and 0.032 gram of AEROSIL® 200 in 7.32 grams of a 98.53/1.48 (by weight percent) mixture of ethanol/water. After drying at 135° C. for 15 minutes, an overcoating layer encompassed by Formula (V) with a thickness of about 5 microns was obtained. The following table summarizes the electrical performance of this device:

| Device No. | CTL (μm) | $V_{ddp}$ (V) | E1/2 (Ergs/cm$^2$) | Dark Decay (V/500 ms) | Vr (V) | Wear (nm/kcycles) |
|---|---|---|---|---|---|---|
| Control Device Without OCL | 24.9 | 804 | 1.43 | 8.9 | 15.2 | 60–100 |
| Device with 4.1 μm Crosslinked Siloxane OCL | 28.7 | 810 | 1.68 | 13.3 | 19.3 | 30–50 |

EXAMPLE VI

A photoresponsive imaging device with an overcoating layer derived from polymer (IV-a) of Example I was prepared in accordance to the procedure of Example V. The overcoating layer was prepared from a dispersion of 0.56 gram of polymer (IV-a) of Example I, 0.24 gram of 3-aminopropyltrimethoxysilane and 0.016 gram of AEROSIL® 200 in 7.34 grams of a mixture 98.53/1.48 (by weight percent) of ethanol/water. After drying at 140° C. for 5 minutes, an overcoating layer encompassed by Formula (v)

of a thickness of about 5 microns was obtained. The following table summarizes the electrical performance of this device:

| Device No. | CTL ($\mu$m) | $V_{ddp}$ (V) | E1/2 (Ergs/cm$^2$) | Dark Decay (V/500 ms) | Vr (V) | Wear (nm/kcycles) |
|---|---|---|---|---|---|---|
| Control Device Without OCL | 24.9 | 804 | 1.43 | 8.9 | 15.2 | 60–100 |
| Device with 4.5 $\mu$m Crosslinked Siloxane OCL | 30.8 | 814 | 1.67 | 14.3 | 6.68 | 40–70 |

EXAMPLE VII

Another photoresponsive imaging device with an overcoating layer derived from Polymer (IV-a) of Example III was fabricated in accordance to the procedure of Example VI. The overcoating layer was prepared from a dispersion of 0.56 gram of polymer (IV-a) of Example III, 0.24 gram of 3-aminopropyltrimethoxysilane and 0.24 gram of AEROSIL® 200 in 9.36 grams of a mixture 98.53/1.48 (by weight percent) of ethanol/water. After drying at 140° C. for 15 minutes, an overcoating layer encompassed by Formula (V) of a thickness of about 3 microns was obtained. The following table summarizes the electrical performance of this device:

| Device No. | CTL ($\mu$m) | $V_{ddp}$ (V) | E1/2 (Ergs/cm$^2$) | Dark Decay (V/500 ms) | Vr (V) | Wear (nm/kcycles) |
|---|---|---|---|---|---|---|
| Control Device Without OCL | 24.9 | 804 | 1.43 | 8.9 | 15.2 | 60–100 |
| Device with 4.5 $\mu$m Crosslinked Siloxane OCL | 30.0 | 801 | 1.61 | 7.3 | 36.0 | 30–60 |

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A photoconductive imaging member comprised of an optional supporting substrate, a photogenerating layer, a charge transport layer, and an overcoating layer comprised of a crosslinked composite polysiloxane-silica generated from the reaction of a silyl-functionalized hydroxyalkyl polymer of Formulas (IV-a), (IV-b), (IV-c), (IV-d), (IV-e), (IV-f), (IV-g), or (IV-h) with an organosilane of Formula (II) in the presence of silica particles and water (II)

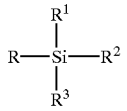

(IV-a)

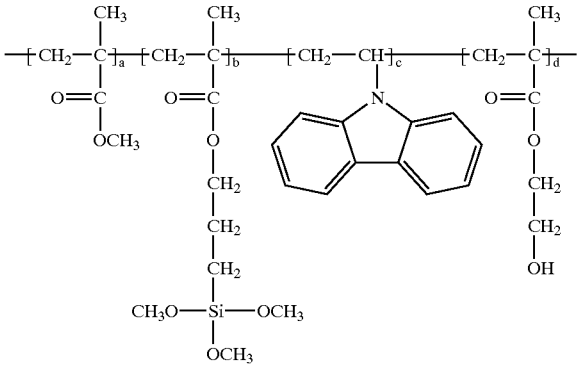

(IV-b)

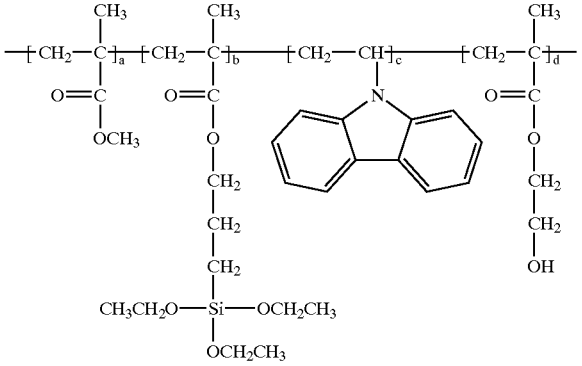

(IV-c)

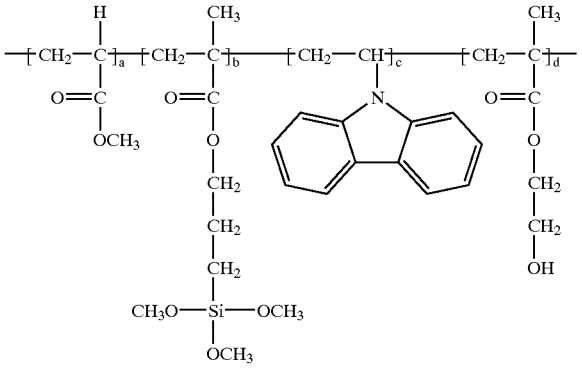

-continued (IV-d)

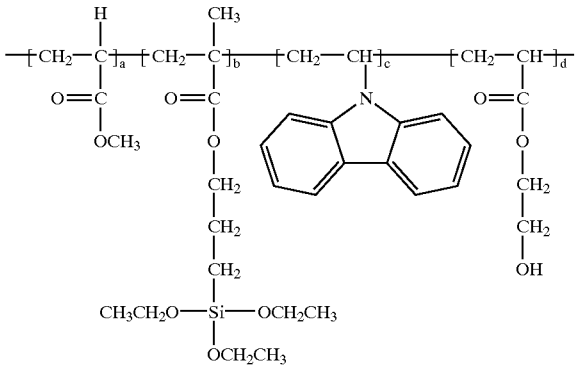

(IV-e)

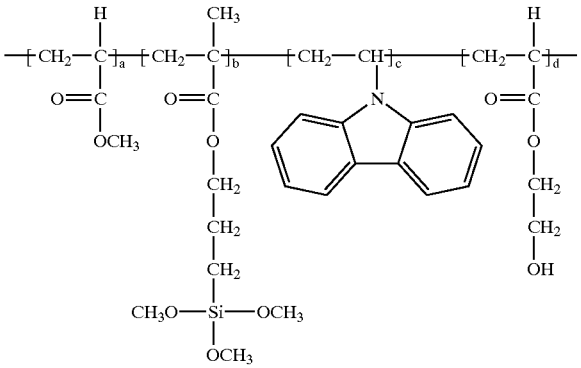

(IV-f)

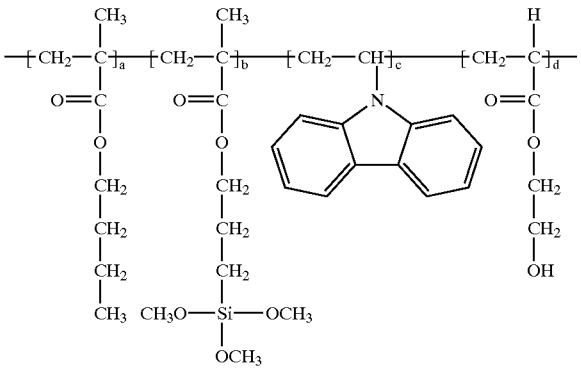

(IV-g)

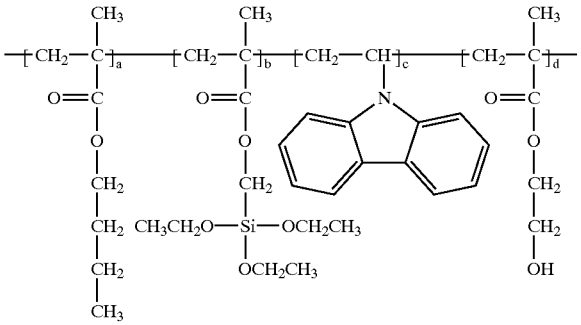

-continued (IV-h)

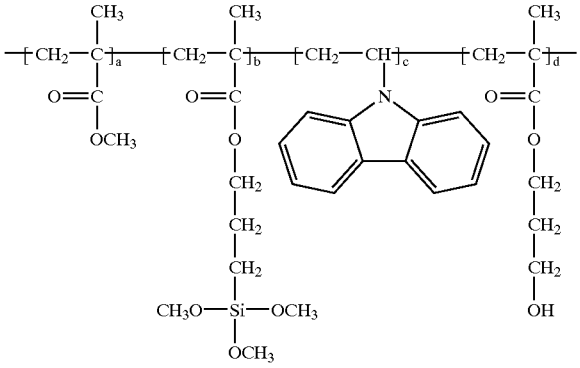

a, b, c, and d each represent mole fractions of the repeating monomer units such that the sum of a+b+c+d is equal to about 1; R is alkyl, substituted alkyl, aryl, or substituted aryl, and $R^1$, $R^2$, and $R^3$ are independently selected from the group consisting of alkyl, aryl, alkoxy, aryloxy, acyloxy, halide, cyano, and amino, subject to the provision that two of $R^1$, $R^2$, and $R^3$ are each independently selected from the group consisting of alkoxy, aryloxy, acyloxy, and halide, and wherein said silyl-functionalized hydroxyalkyl polymer possesses a weight average molecular weight $M_w$ of from about 10,000 to about 100,000.

2. An imaging member in accordance with claim 1 wherein said silyl-functionalized hydroxyalkyl polymer possesses a number average molecular weight $M_n$ of about 1,000 to about 50,000.

3. An imaging member in accordance with claim 1 wherein said organosilane (II) is aminoalkyltrialkoxysilane.

4. An imaging member in accordance with claim 1 wherein said organosilane is the aminoalkyltrialkoxysilane aminoalkyltrimethoxy silane.

5. An imaging member in accordance with claim 1 wherein said organosilane is 3-aminopropyltrimethoxysilane or 3-aminopropyltriethoxysilane.

6. An imaging member in accordance with claim 1 wherein said overcoating layer is of a thickness of from about 0.01 to about 10 microns.

7. An imaging member in accordance with claim 1 wherein said overcoating layer is of a thickness of from about 1 to about 5 microns.

8. An imaging member in accordance with claim 1 comprised in the following sequence of a supporting substrate, an adhesive layer, a photogenerating layer, a charge transport layer and said overcoating layer.

9. An imaging member in accordance with claim 8 wherein the adhesive layer is comprised of a polyester with an optional $M_w$ of about 70,000, and an optional $M_n$ of about 35,000.

10. An imaging member in accordance with claim 1 wherein the supporting substrate is comprised of a conductive substrate.

11. An imaging member in accordance with claim 8 wherein the conductive substrate is aluminum, aluminized polyethylene terephthalate or titanized polyethylene terephthalate.

12. An imaging member in accordance with claim 1 wherein said photogenerator layer is of a thickness of from about 0.05 to about 10 microns, and said transport layer is of a thickness of from about 10 to about 50 microns.

13. An imaging member in accordance with claim 1 wherein the photogenerating layer is comprised of photogenerating pigments dispersed in a resinous binder in an amount of from about 5 percent by weight to about 95 percent by weight, and optionally wherein the resinous binder is selected from the group consisting of polyesters, polyvinyl butyrals, polycarbonates, polystyrene-b-polyvinyl pyridine, and polyvinyl formals.

14. An imaging member in accordance with claim 1 wherein said charge transport layer comprises aryl amine molecules of the formula

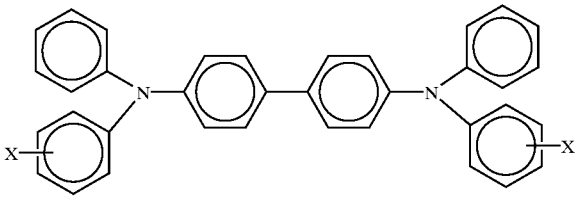

wherein X is selected from the group consisting of alkyl and halogen, and wherein the aryl amine is optionally dispersed in a highly insulating and transparent resinous binder.

15. An imaging member in accordance with claim 14 wherein the aryl amine is N,N'-diphenyl-N,N-bis(3-methyl phenyl)-1,1'-biphenyl-4,4'-diamine.

16. An imaging member in accordance with claim 1 wherein the photogenerating layer is comprised of metal phthalocyanines, metal free phthalocyanines, or a hydroxygallium phthalocyanine.

17. A method of imaging which comprises generating an image on the imaging member of claim 1, developing the latent image, and optionally transferring the image to a substrate.

18. An imaging member in accordance with claim 1 wherein the composite is crosslinked by crosslinking in the presence of a catalyst selected from the group consisting of carboxylic acids and amines.

19. An imaging member in accordance with claim 16 wherein acetic acid or an alkylamine is selected as the catalyst.

20. An imaging member in accordance with claim 1 wherein the silyl-functionalized hydroxyalkyl polymer possesses an $M_w$ of from about 20,000 to about 60,000.

21. An imaging member in accordance with claim 1 wherein the silyl-functionalized hydroxyalkyl polymer possesses an $M_n$ of from about 3,000 to about 20,000.

22. A xerographic apparatus comprising a charging component, a photoconductive component of claim 1, a development component, a transfer component, and an optional cleaning component.

* * * * *